United States Patent [19]

Rapp

[11] Patent Number: 5,040,369

[45] Date of Patent: Aug. 20, 1991

[54] METHOD AND APPARATUS FOR TOPPING OFF A HYDROPNEUMATIC PRESSURE INTENSIFIER WITH OIL

[76] Inventor: Eugen Rapp, Max-Reger-Str., 7981 Berg, Fed. Rep. of Germany

[21] Appl. No.: 397,614

[22] Filed: Aug. 22, 1989

[30] Foreign Application Priority Data

Aug. 24, 1988 [DE] Fed. Rep. of Germany ..... 3828699

[51] Int. Cl.[5] ..... F15B 7/00

[52] U.S. Cl. ..... 60/560; 60/584

[58] Field of Search ..... 60/560, 563, 565, 583, 60/584, 593; 417/225

[56] References Cited

U.S. PATENT DOCUMENTS

| | | | |
|---|---|---|---|
| 3,253,412 | 2/1964 | Torossian | 60/584 |
| 3,426,530 | 10/1967 | Georgelin | 60/560 |
| 4,072,013 | 2/1978 | Barbareschi | 60/560 |
| 4,153,180 | 5/1979 | Fernique | 60/560 |
| 4,300,351 | 11/1981 | Grullmeier | 60/560 |

*Primary Examiner*—Edward K. Look
*Assistant Examiner*—F. Daniel Lopez
*Attorney, Agent, or Firm*—Edwin E. Greigg; Ronald E. Greigg

[57] ABSTRACT

A method for topping off a reservoir chamber of a hydropneumatic pressure intensifier with oil, and the embodiment of such a hydropneumatic pressure intensifier, in which the reservoir chamber has a vent bore, which being usable as an overflow protection means as well is controlled by a flow control valve and is uncovered preferably by the reservoir piston in its outset position. In the event of improper aeration, the reservoir piston is thrust against a stop determining its extreme position, in a further feature of the invention a second vent bore can be uncovered by such movement.

17 Claims, 2 Drawing Sheets

METHOD AND APPARATUS FOR TOPPING OFF A HYDROPNEUMATIC PRESSURE INTENSIFIER WITH OIL

BACKGROUND OF THE INVENTION

The invention is based on a method for topping off a reservoir chamber of a hydropneumatic pressure intensifier with oil, and on a known type of hydropneumatic pressure intensifier for performing the method.

In such hydropneumatic pressure intensifiers (German Patent 28 18 337 or German Offenlegungsschrift 28 10 894), hydraulic oil lost from leakage is replaced from time to time during operation by topping off the reservoir chamber. The hydraulic oil is pumped into the chamber from outside the pressure intensifier via a nipple; in the process, the spring-loaded reservoir piston is correspondingly displaced counter to the spring force. The spring force is usually generated by a mechanical helical spring or by a gas spring, in each case acting upon the end of the reservoir piston remote from the reservoir. Naturally, other means for generating the spring force are also possible.

One problem in topping off the reservoir chamber with oil is the venting of the reservoir chamber, which naturally is necessary when the chamber is first filled with hydraulic oil but may also be necessary when the hydraulic oil is topped off, specifically whenever air from the spring chamber has reached the reservoir chamber via the radial seals of the reservoir piston. Such harmful air may also have entered the reservoir chamber from the work chamber, for instance if the radial seals on the work piston are inadequately tight for the pneumatic pressures engaging the work piston.

Typically, venting of the reservoir chamber takes place through a vent bore, which is closed off by a vent screw that must be removed for hydraulic oil topping off and for intentional venting. Venting when topping off the oil is often unnecessary, however, so in that case the vent bore is not opened. Depending on the structural design of the reservoir spring and spring chamber, the reservoir piston may be displaced so far into the spring chamber, if the oil is not topped off carefully, that the radial outer seals overtake connection bores of the spring chamber, so that in the course of time they may become damaged. Unlike the vent bore, which has only a small diameter, these connection bores of the spring chamber are relatively large. These connection bores are used for instance for a gas spring, or if a helical spring is disposed in the spring chamber, they are used for the primary venting of the spring chamber.

If air is present in the reservoir chamber, however, then it can cause foaming of the hydraulic oil, leading to functional problems or inadequate pressure intensification.

Another disadvantage of these known pressure intensifiers is that if the topping off of the oil, which must of course always be done under a certain amount of pressure, is done without monitoring, the work piston is shifted out of its initial position, since after the end of the deflection stroke of the reservoir piston the hydraulic oil fed into the reservoir chamber escapes from the reservoir chamber into the work chamber. This necessitates draining the hydraulic oil, which is time-consuming. In any case, in the known pressure intensifiers, it is difficult to monitor the oil topping off process.

OBJECT AND SUMMARY OF THE INVENTION

The method according to the invention for topping off the reservoir chamber of a hydropneumatic pressure intensifier, and the hydropneumatic pressure intensifier for performing the method, as defined herein, has the advantage over the prior art that any amounts of air present in the reservoir chamber, or entering it during the topping off of the reservoir chamber with hydraulic oil, are automatically vented. Since the topping off with oil always takes place at a certain overpressure, which overcomes the force of the reservoir spring, the various pressures, or the forces effecting the pressures, are exploited to displace the reservoir piston during the topping off process until such time as the oil topping off is terminated, which is after sufficient topping off has taken place but before the work piston is displaced. This termination may be effected according to the invention by opening the flow control valve, for example a pressure maintenance valve, so that a certain pressure in the reservoir chamber is not exceeded. Naturally, this interruption instead can be effected by terminating the oil topping off process upon attainment of a topping off pressure that is somewhat higher than the reservoir pressure, but lower than the pressure that must prevail at the work piston in order to displace it. In each case, according to the invention, the maximum pressure in the reservoir chamber during oil topping off has an upper limit, preferably in combination with an automatic control (venting).

In an advantageous feature of the invention, the pressure is limited by a pressure maintenance valve, functioning in a known manner in which, if a certain pressure is exceeded, either opens, to reduce the excess pressure, or closes, to prevent an excess pressure; thus this type of pressure maintenance valve can be disposed at either the oil overflow or the oil inflow point. A check valve, which opens if the reservoir pressure is correspondingly exceeded, may also be used as a flow control valve having simultaneous venting action.

In a further advantageous feature of the invention, the vent opening is covered by the reservoir plunger only in the outset position of the plunger. This is useful for venting purposes only if the cylinder receiving the reservoir piston is installed vertically, which is typical, so that the air can collect over the oil column and under the reservoir piston; the air then escapes later, automatically, after the appropriate displacement of the reservoir piston, so that oil can only then flow in to replace it. Purely as a safety feature to prevent excess oil pressure in the reservoir chamber, the installation position does not play a decisive role. The flow control valve to be used here must in any case prevent a return flow of air from outside into the reservoir chamber via the vent bore.

In a further advantageous feature of the invention, two vent bores are provided; one is opened only in the outset position and the other only upon further displacement of the reservoir piston toward the reservoir spring, in the extreme position of the reservoir piston. While the reservoir piston during normal operation always returns to its outset position and in so doing uncovers the first vent bore, through which venting can then take place continuously, the second vent bore is uncovered only if some error occurs during oil refilling, for instance if too much oil is pumped into the system and cannot be adequately drained off via the first, relatively small vent bore. As soon as the overfilling is tended, the reservoir spring then displaces the reservoir piston back again by a short distance, whereupon this second vent opening is closed by the reservoir piston. In the then resultant floating outset position of the reservoir piston determined by the reservoir pressure, the first vent opening is still open, to assure contiguous venting. Advantageously, the second vent bore may also be controllable by a flow control valve, although the reservoir piston itself, with its radial seals in combination with the mouth of this second vent bore, functions as a flow control valve, and thus an extra flow control valve serves as additional protection against leaking air.

In another advantageous feature of the invention, the extreme position of the reservoir piston is determined by a stop, so that when hydraulic oil is being topped off the reservoir piston is displaced against this stop before the vent or overflow prevention means opens, to allow the air, or excessive hydraulic fluid, to escape. As a result, the reservoir piston is in particular prevented from being displaced so far that the radial seal could be damaged by any connections that it might have overtaken.

In yet another advantageous feature of the invention, annular grooves (labyrinth grooves) facing the cylinder wall and the plunger piston are provided in the reservoir piston for diverting leaking oil and leaking air. This assures that any leakage, which is possible if different pressure prevail in the spring chamber and in the reservoir-chamber, is drained away harmlessly. Air which enters into the reservoir chamber can cause foaming of the oil, and can also get into the work chamber, which can cause considerable functional problems, in particular an inadequate generation of force.

In another advantageous feature of the invention, in which a compression spring acts as the reservoir spring, the spring chamber has a fixed partition, with a central bore, aligned with the guide bore, in which the plunger piston guides in a radially sealing manner; the partition acts as a stop for the reservoir piston. When compressed air is used as the reservoir spring, the spring chamber is typically reduced virtually to zero—to economize on the structural length of the pressure intensifier—since the force of the reservoir spring is determined by the air pressure, which also prevails in the supply lines to the spring chamber and can be maintained by the air supply itself.

In still another advantageous feature of the invention, a securing ring engaging a corresponding groove in the inner wall of the cylinder bore receiving the reservoir piston serves as the stop. Such a securing ring is no problem to insert into the suitably provided provided groove of the cylinder bore during the assembly of the pressure intensifier. To obtain a wear-resistant apparatus with the longest possible service life, in a further feature of the invention a loose stop ring, the outside diameter of which is equivalent to the inside diameter of the cylinder bore, is disposed between the reservoir piston and the securing ring. This latter feature is particularly advantageous when a helical spring is used as the reservoir spring, in which case the helical spring is supported on the stop ring. Naturally, this feature can also be advantageously used if a gas spring is used as the reservoir spring.

Just as a helical spring with a dual function as the reservoir spring and as a restoring spring can be inserted between the reservoir piston and the work piston of the plunger piston, compressed air engaging the reservoir piston on the one hand and the work piston on the other can serve as the reservoir spring, having the same function. In that case, the air pressure acting upon this work piston must be correspondingly higher than the reservoir spring pressure, in order to drive the plunger piston.

In another advantageous feature of the invention, the flow control or pressure maintenance valve may be embodied by a device having an elastic valve element, which is pressed from outside via a rocker against the mouth of the vent bore; the rocker is supported with radial play on a collar screw, and the closing force is determined by a resilient element engaging the other lever end of the rocker. Rubberlike elements can be used as the resilient element or movable valve element, and the opening force of this valve is determined by the cross section of the mouth of the vent bore and the elastic forces of the rubber elements.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
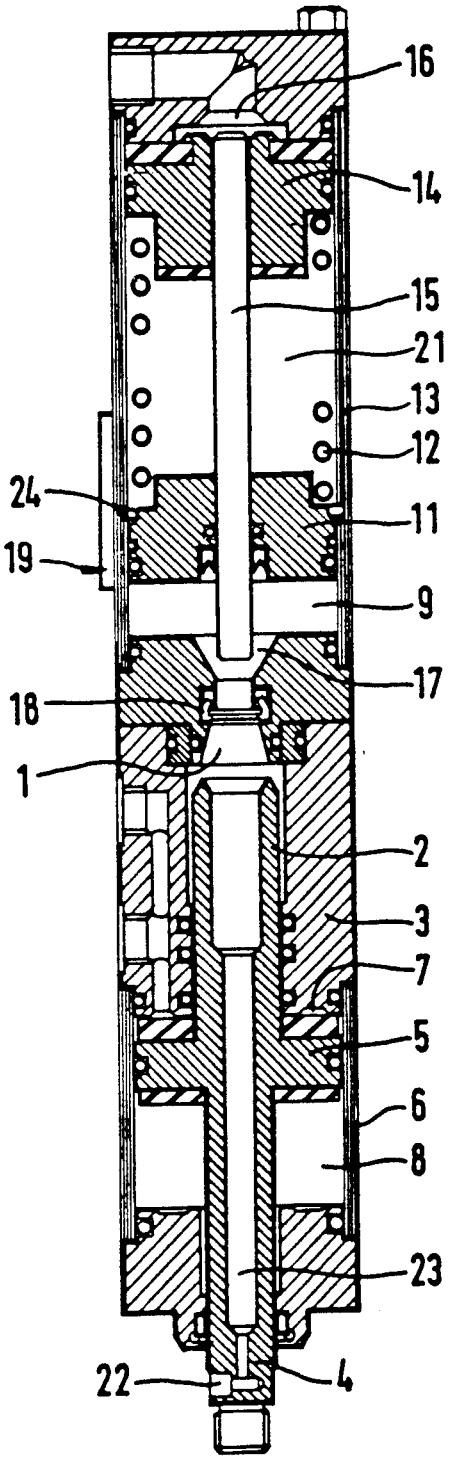
FIG. 1 shows a hydropneumatic pressure intensifier in longitudinal section, as a first exemplary embodiment.

The pressure intensifier shown in FIG. 1 has cylindrical outside dimensions, although it may take other external forms as well, such as two cylinders side by side or a cube-like embodiment. In the example shown, a work piston 2 is axially displaceably disposed in a work chamber 1 filed with hydraulic oil and is radially sealingly guided in a bore of a housing 3 of the pressure intensifier. A piston rod 4 is disposed on the work piston 2 to transmit force. The work piston 2 also has an auxiliary piston 5 disposed on it in the form of the collar, which is radially sealed off with respect to a jacket tube 6, thereby defining two chambers 7 and 8, which are pneumatically supplied for the sake of rapid return of the work piston. As soon as sufficient compressed air flows into the chamber 7, the work piston 2 is displaced downward, while contrarily if compressed air is pumped into the chamber 8, the work piston 2 returns to its outset position, shown.

Above the work chamber 1 and hydraulically communicating with it is a reservoir chamber 9 for hydraulic oil; its reservoir pressure is generated by a reservoir piston 11 and a reservoir spring 12. The reservoir piston 11 is radially sealingly guided in an axially displaceable manner in a jacket tube 13. Again radially sealingly and axially displaceably, a drive piston 14 of a plunger piston 15 is supported in this jacket tube 13 such that it is displaceable in the direction of the work chamber 1 counter to the force of the reservoir spring 12. The plunger piston 15 passes through the reservoir piston 11 in a radially sealed manner and plunges into the reservoir chamber 9. The drive piston 14 and plunger piston 15 are driven by compressed air, which is fed into a chamber 16 above the drive piston 14. This is done once the work piston 2 has completed its rapid return, i.e. when the tool attached to the piston rod 4 has returned to its working position. When the drive piston 14 is displaced by the compressed air, the plunger piston 15, after traveling a certain stroke length, plunges into a connecting bore 17 leading from the reservoir chamber 9 to the work chamber 1, after which this connection is interrupted in cooperation with a radial seal 18. As the plunger piston 15 continues to plunge into the work chamber 1, hydraulic fluid is positively displaced there, resulting in a correspondingly higher work pressure in the work chamber 1. This pressure is equivalent to the intensification ratio of the work faces of the drive piston 14 and plunger piston 15, based on the pneumatic pressure exerted on the drive piston 14. This high hydraulic pressure acts directly upon the work piston 2 and effects the desired large force at the piston rod 4. For the return stroke, the pneumatic pressure in the drive chamber 16 is reduced, so that the reservoir spring 12 displaces the drive piston 14 back into the outset position shown, after which hydraulic fluid, positively displaced out of the work chamber 1 by the work piston 2, flows into the reservoir chamber 9, and the work piston 2 is displaced into the outset position shown by compressed air, which engages the auxiliary piston 5, in the chamber 8.

Figure 2:
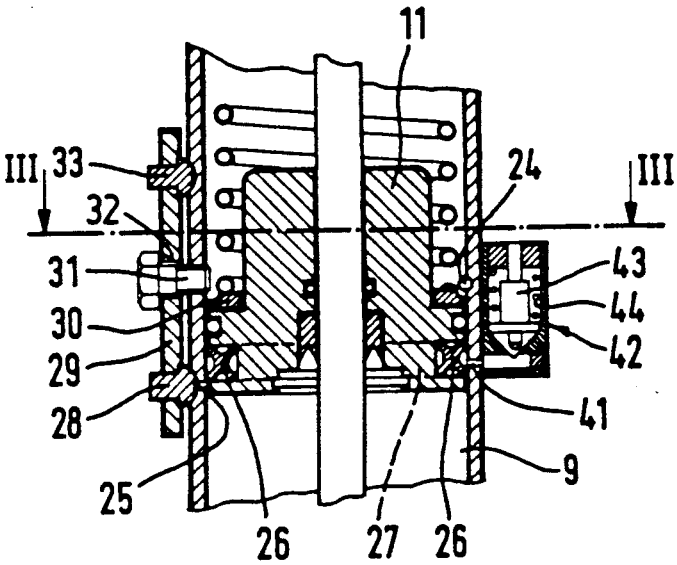
FIGS. 2 and 3 show a detail of FIG. 1 on a larger scale, in longitudinal and cross section, respectively.

In a hydropneumatic pressure intensifier of this kind, which is known per se, a vent device having overfill preventers 19 and 42, described in detail in conjunction with FIG. 2, is provided according to the invention.

During the operation of such a hydropneumatic pressure intensifier, losses of hydraulic oil occur from leakage through the various radial seals, and these losses must be compensated for. Also, air leaks past the radial seals to reach the reservoir chamber 9 and work chamber 1, particularly from the chamber 7 which is at air pressure and from the spring chamber 21 receiving the reservoir spring, and so from time to time the reservoir chamber 9 and hence the work chamber 1 must be vented. In this exemplary embodiment, the hydraulic oil refilling is effected via a fill screw 22, which is present on the piston rod 4 and from which a conduit 23 extending in the piston rod 4 leads to the work chamber 1.

The outset position of the reservoir piston 11 that is shown in FIG. 1 is determined by the balance of forces between the force of the reservoir spring 12 and the force resulting from the hydraulic pressure times the surface area of the reservoir piston. Only if the pressure in the reservoir chamber 9 rises to an unallowable extent is the reservoir piston 11 displaced into an extreme position in contact with a stop ring 24, which engages a corresponding groove in the inside wall of the jacket tube 13. As soon as the aforementioned leakage losses arise in the reservoir chamber 9, the reservoir piston 11 is retained correspondingly downward by the reservoir spring 12, in such a way that the reservoir piston 11 no longer reaches its outset position shown, below the stop embodied by the stop ring 24. Only once hydraulic oil is again refilled into the work chamber 1 or reservoir chamber 9 is the reservoir piston 11 displaced correspondingly upward in the direction of the stop 24.

Although the air undesirably entering the reservoir chamber 9 or work chamber 1 has the opposite effect form the hydraulic leakage losses, because the air causes an increase in volume, it must nevertheless be removed—vented—to prevent foaming of the oil or in other words to assure the incompressibility of the oil.

As can be seen from FIG. 2, to increase the wear resistance, a steel ring 30 is provided on the one hand between the reservoir pistol 11 and the stop ring 24, with the reservoir spring 12 also supported on the steel ring; on the other hand, the entrance to a first vent bore 25 is opened by the reservoir piston 11 in the desired outset position shown. However, as soon as the reservoir piston is displaced farther downward, to compensate for the loss in volume resulting from the displacement of the work piston 2, the vent bore 25 is disconnected from the reservoir chamber 9 by a ring seal 26, which is disposed in an annular groove 27 of the reservoir piston. If to initiate the high pressure the plunger piston 15 is subsequently displaced downward, causing a certain positive displacement in the reservoir chamber 9, the reservoir piston 11 is displaced back again counter to the reservoir spring 12—although with a certain pressure increase—yet without reopening the vent bore 25; that is, despite this slight pressure increase, oil cannot escape from the reservoir into the vent bore. Once the work cycle has ended, when the reservoir piston 11 resumes its outset position shown, any amounts of air that may have undesirably entered the work chamber 1 or reservoir chamber are automatically vented via the vent bore 25.

The mouth of the vent bore 25 is controlled by a mushroom-shaped, movable valve element 28, which is supported on a vent plate 29 embodied as a rocker. The vent plate 29 is anchored to the jacket tube 13 with a collar screw 31, and between the shaft of the collar screw 31 and the bore 32 of the vent plate that receives the collar of the collar screw, a certain play is provided, to enable rocking of the vent plate 29 while the collar screw 31 remains stationary. The closing force of the valve element 28 and hence the pressure control of the reservoir chamber pressure is determined by a second rubber mushroom element 33, which engages the other end of the vent plate 29.

When the fill screw 22 is opened for topping off the hydraulic oil, and hydraulic oil is fed in at a certain pressure, it flows via the conduit 23 into the work chamber 1 and from there into the reservoir chamber 9, whereupon the reservoir piston 11 is displaced upward, counter to the force of the reservoir spring. Normally, the vent plate is removed both for topping off and for the initial filling, to allow an unhindered flow of air outward and to make it easy to tell when the venting is finished and nothing but hydraulic oil is flowing through the vent bore 25. However, if someone forgets to remove the vent plate 29 and with it the movable valve element 28, then because of the resultant greater throttle effect upon the outflow of air and hydraulic oil, the reservoir piston 11 is displaced farther upward, until it meets the stop ring 24. In the outset position, and naturally in this extreme position, in which the vent bore 25 is exposed, the hydraulic pressure of the reservoir chamber 9 acts directly on the movable valve element 28. Once any air in the reservoir chamber 9 has escaped, hydraulic oil flows via this vent bore 25 past the valve element, and from this it can be ascertained that sufficient topping off of the oil has taken place, and so that topping off operation can be terminated.

Figure 3:
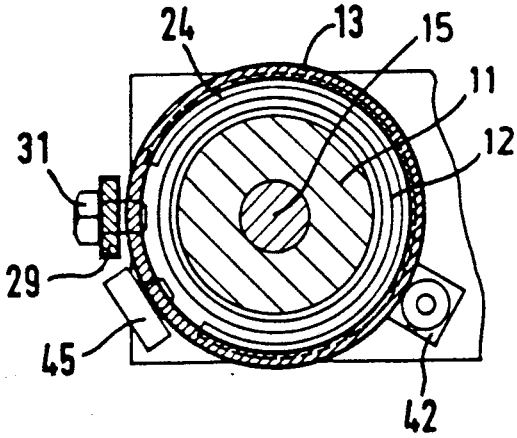

FIG. 3 shows a cross section through the first exemplary embodiment taken along the line III, particularly showing the securing ring 24. From this figure, it can also be seen that the securing ring 24 is split at the point where the collar screw 31 is screwed into the jacket tube 13.

Figure 4:
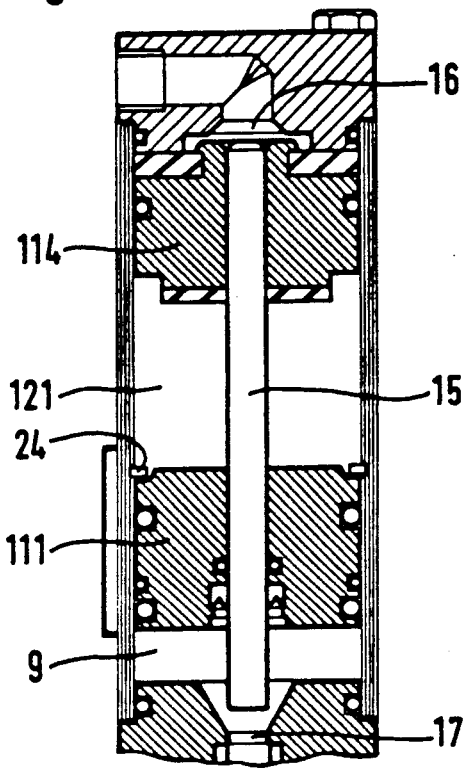
FIG. 4 shows part of a pressure intensifier in longitudinal section, as a second exemplary embodiment.

In the second exemplary embodiment shown in FIG. 4, the pressure intensifier has basically the same design as the first. Unlike the first embodiment, though, the reservoir spring this time is a gas spring, which acts in the form of air pressure in the spring chamber 121. Since the demands made of the radial seals are particularly great in this case, the drive piston 114 and reservoir piston 111 are designed accordingly as well. While virtually no air overpressure prevails in the spring chamber 21 in the first exemplary embodiment, in the spring chamber 121 of this second exemplary embodiment a correspondingly sufficiently high air pressure is present to generate the required spring force. As a result, the danger of leakage of air into the reservoir chamber 9 is increased. To enable the drive of the drive piston 114 counter to the gas spring, the driving air pressure required in the drive chamber 16 must be correspondingly higher than the gas spring pressure. By a simple pneumatic control, however, a complete pressure relief of the spring chamber 121 can take place simultaneously with the delivery of the compressed air to the drive chamber 16, because from the moment that the plunger piston 15 plunges into the connecting bore 17, the pressure in the reservoir chamber 9 and thus the gas spring are no longer necessary.

Figure 5:
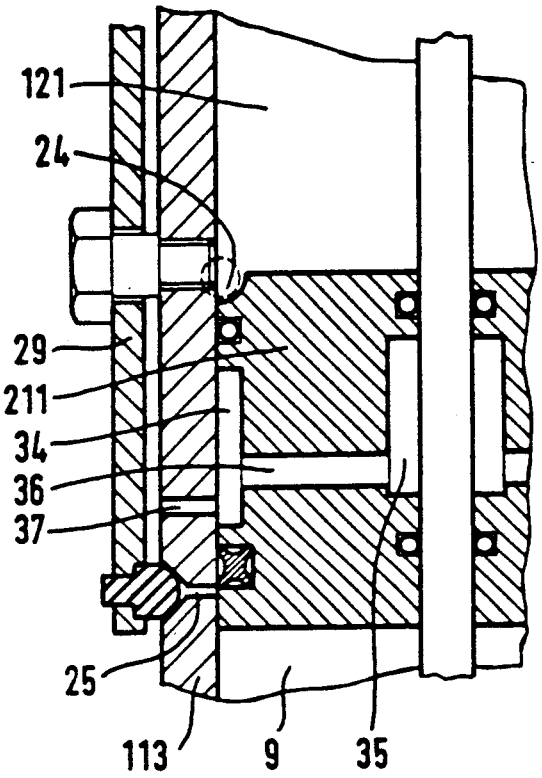
FIG. 5 shows a detail of FIG. 4 on a larger scale, but as a variant of this second exemplary embodiment.

In FIG. 5, the reservoir piston 211 has, as a seal, additional annular leakage grooves 34 and 35, which have a connecting bore 36; of these grooves, the annular leakage groove 34 is vented via a leakage bore 37 disposed in the jacket tube 113. This prevents any leakage of compressed air from the gas spring out of the spring chamber 121 into the reservoir chamber 9.

Figure 6:
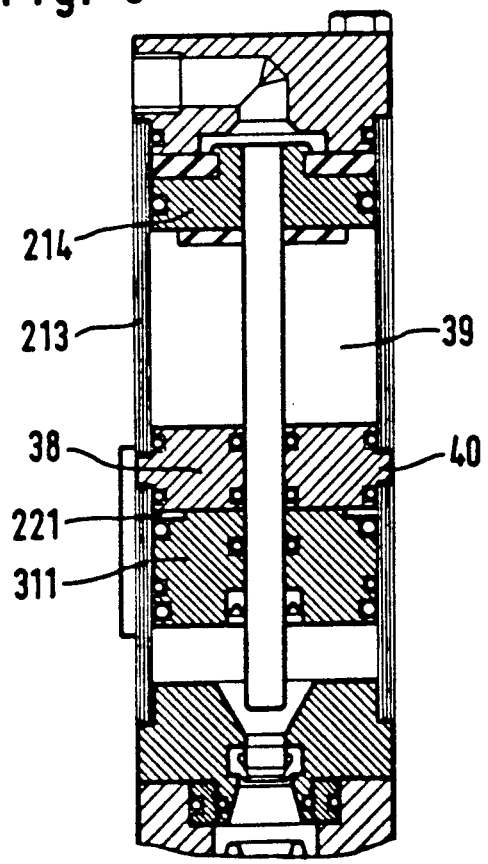
FIG. 6 shows part of a pressure intensifier in longitudinal section, as a third exemplary embodiment.

In the third exemplary embodiment shown in FIG. 6, which like the second exemplary embodiment operates with a gas spring, this spring on the one hand engages the reservoir piston 311 but on the other also engages a partition 38 disposed in the jacket tube 213, rather than the drive piston 214 as in the second exemplary embodiment. Thus the chamber 39 above the partition 38 does not have any control function and can be filled only with air at low pressure, in order to return the drive piston 214 to its outset position. Naturally, instead of this kind of pneumatic restoring force, a helical spring may be used, which then is disposed between the work piston 214 and the partition 38. The jacket tube 213 is split to receive the partition 38, and a corresponding collar 40 is present radially on the partition 38.

The air is delivered to the gas spring chamber 221, which in the position shown is shrunk virtually to zero, via a bore, not shown.

Figure 7:
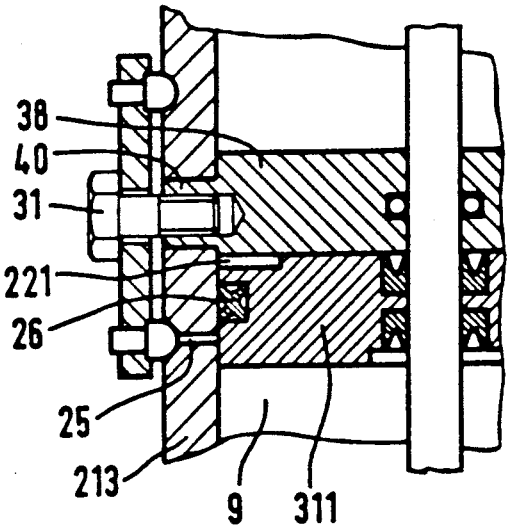
FIG. 7 is a detail of FIG. 6, on a larger scale and as a variant.

Unlike FIG. 5, in the variant of FIG. 7 of the third exemplary embodiment the collar screw 31 is secured to the partition 38 or the collar 40. In any case, in this third exemplary embodiment the partition 38 serves as an extreme stop for the reservoir piston 311, and in this extreme position, shown, the vent bore 25 is naturally uncovered. Otherwise, this third embodiment operates like the exemplary embodiments described above.

In the event of incorrect topping off of the system, and especially if the removal of the vent plate 29 during topping off has been forgotten, the invention provides that a further vent bore can be uncovered by the reservoir piston in the extreme position of that piston. A supplementary device of this kind is shown in FIGS. 2 and 3. The reservoir piston 11 there is in its outset position, in which a second vent bore 41 is still closed by the ring seal 26 embodied as a quad ring. Only once the reservoir piston 11 is displaced farther upward into its extreme position, in which the steel ring 30 strikes the securing ring 24 acting as a stop, is this second vent bore 41 uncovered by the reservoir piston 11. The vent bore 41 is followed by a check valve 42 having a movable valve element 43, which is loaded by a closing spring 44.

In principle, naturally the first vent bore 25 can also be controlled via a check valve of this kind, or both vent bores 25 and 41 may each be controlled by a vent plate, such as that shown in FIG. 2, for example.

In FIG. 3, reference numeral 45 indicates an additional nipple 45 of the spring chamber 21; this nipple may be used for venting, but also for supplying air, for instance if a gas spring is used.

The foregoing relates to preferred embodiments of the invention, it being understood that other variants and embodiments thereof are possible within the spirit and scope of the invention, the latter being defined by the appended claims.

What is claimed and desired to be secured by Letters Patent of the United States is:

1. A method for topping off a reservoir chamber 9 of a hydropneumatic pressure intensifier with oil and venting air from said reservoir chamber during topping off with oil and during use, providing a work chamber (1) hydraulically connectable to the reservoir chamber, in which work chamber a work piston (2) is acted upon displaceably out of its outset position counter to a restoring force (8) and wherein during a rapid traverse of the work stroke away from said reservoir chamber hydraulic oil at reservoir pressure flows from the reservoir chamber into the work chamber and back again in the return stroke, actuating a plunger piston (15), for pressure intensification counter to a restoring force (12) and after the rapid traverse of the work piston (2), said plunger piston plunges into a passage (17) connecting said reservoir chamber with said work chamber, simultaneously hydraulically disconnecting the reservoir chamber and the work chamber, generating a reservoir pressure by means of a pneumatic or mechanical force (16) via a reservoir spring (12) which acts upon a reservoir piston (11), automatically venting the reservoir chamber to remove a quantity of leaking air or overfilling quantities reaching the reservoir chamber, and topping off the reservoir chamber or work chamber with oil from time to time in the intervals between work periods, to compensate for any oil losses occurring from leakage, and further providing for a topping off of the reservoir chamber (9) with oil, in which the topping off pressure is greater than the reservoir pressure effected by said reservoir spring (12) and established during normal operation, and further wherein the topping off pressure is just high enough that the thereby generated force engaging it and thrusting it into its outset position, so that the work piston (2) always returns to its outset position.

2. A method as defined by claim 1, in which the topping off pressure is determined by at least one pressure maintenance valve (25, 28–33, 41, 42) of the reservoir chamber (9).

3. A method as defined by claim 2, in which the pressure maintenance valve also acts as a venting valve.

4. A method as defined by claim 2, in which at least two pressure-dependent pressure maintenance valves can be switched on in succession.

5. A hydropneumatic pressure intensifier comprising an elongated hollow body having a bore provided with an axially arranged series of actuatable elements including a reservoir spring which spring-loads an axially displaceable and radially sealing reservoir pistol (11) to generate a reservoir pressure, which reservoir piston divides an oil-filled reservoir chamber (9) from an air-filled spring chamber (21) which receives the reservoir spring, a central guide bore in said reservoir piston, a transverse partition between a work chamber (1) and the reservoir chamber (9), said transverse partition including a central connecting bore (17), a radially sealingly and axially displaceable drive piston (14) and a plunger piston (15) supported within said hollow body, said plunger piston (15) passes through said central guide bore in said reservoir piston and plunges into said connecting bore (17) for initiating a high-pressure phase after a suitable prestroke, said drive piston further including pneumatically impingeable drive means, an oil filling device for filling the work chamber (1) and the reservoir chamber (9) and a venting device for the reservoir chamber (9) which includes a vent bore (25), said venting device (19) includes a flow control valve (28–33) which controls the vent bore (25), said flow control valve is arranged to have a closing pressure which is greater than a work pressure of the reservoir (9), whereby the flow control valve (28–33) does not open until the closing pressure of the flow control valve is exceeded by fluid pressure in the reservoir (9).

6. A hydropneumatic device as defined by claim 5, in which the closing pressure is exceeded whenever the reservoir piston (11) is displaced into an extreme position against a stop ring (24).

7. A hydropneumatic device as defined by claim 5, in which the drive piston (14) is actuated pneumatically.

8. A hydropneumatic device as defined by claim 5, in which the vent bore (25) is uncovered by the reservoir piston (11, 111) at an outset position of said reservoir piston.

9. A hydropneumatic device as defined by claim 5, which includes first and second vent bores (25, 41), said first bore (25) is uncovered in an outset position of said reservoir piston and said second bore (41) is subsequently uncovered, upon further displacement of the reservoir piston (11) in a direction of a stop spring when the reservoir piston (11) attains an extreme position.

10. A hydropneumatic device as defined by claim 9, in which the second vent bore (41) is likewise controllable by a flow control valve (42).

11. A hydropneumatic device as defined by claim 5, in which an extreme position of the reservoir piston (11, 111) is determined by a stop means (24, 38).

12. A hydropneumatic device as defined by claim 11, in which a stop ring (24), acts as a stop means and is arranged to engage a corresponding groove in said bore of said hollow body which receives the reservoir piston (11, 111).

13. A hydropneumatic device as defined by claim 12, in which a steel ring (30) is disposed between the reservoir piston (11) and the stop ring (24), the outside diameter of said steel ring being equivalent to the bore of the hollow body which receives the reservoir piston (11).

14. A hydropneumatic device as defined by claim 7, in which said reservoir spring further comprises air, and that the spring chamber (39) is defined by said drive piston (214) and a stationary partition (38), said stationary partition is provided with a central bore aligned with the central guide bore in said reservoir piston, and in which said central guide bore and said guide bore the plunger piston (15) slides radially and sealingly.

15. A hydropneumatic device as defined by claim 7, in which a helical spring (12) serves as the reservoir spring, said helical spring being supported on one end by the reservoir piston (11) and on the other end by the drive piston (14).

16. A hydropneumatic device as defined by claim 5, in which said plunger piston (15) is arranged to communicate with a radial annular leakage stoppage grooves (34, 35) for draining away leaking air and leaking oil.

17. A hydropneumatic device as defined by claim 5, in which said flow control valve includes a movable valve element (28) which controls the vent opening (25) and is disposed on a rocker element (29), said rocker element being supported with play on a collar screw (31), and further wherein the closing force of said rocker element is determinable via a resilient element (33) that is adapted to engage the one end of the rocker element (29).

* * * * *